US005174387A

United States Patent [19]

Arndt et al.

[11] Patent Number: 5,174,387

[45] Date of Patent: Dec. 29, 1992

[54] METHOD AND APPARATUS FOR ADAPTING THE OPERATIONAL BEHAVIOR OF A PERCUSSION MECHANISM TO THE HARDNESS OF MATERIAL THAT IS BEING POUNDED BY THE PERCUSSION MECHANISM

[75] Inventors: Friedrich K. Arndt; Robert-Jan Bartels; Heribert Vielhaber, all of Essen, Fed. Rep. of Germany

[73] Assignee: Krupp Maschinentechnik Gesellschaft mit beschränkter Haftung, Essen, Fed. Rep. of Germany

[21] Appl. No.: 795,315

[22] Filed: Nov. 20, 1991

[30] Foreign Application Priority Data

Nov. 20, 1990 [DE] Fed. Rep. of Germany ..... 4036918

[51] Int. Cl.[5] ..... E21C 3/32

[52] U.S. Cl. ..... 173/1; 173/2; 173/176; 173/206; 91/300; 91/321; 175/27

[58] Field of Search ..... 173/1, 2, 4, 9, 176, 173/206; 175/27; 91/307, 308, 321, 300, 317

[56] References Cited

U.S. PATENT DOCUMENTS

| | | | |
|---|---|---|---|
| 3,721,095 | 3/1973 | Chelminski | 173/2 |
| 3,780,814 | 12/1973 | Herb | 173/2 |
| 4,341,271 | 7/1982 | Anttila | 173/2 |
| 4,403,890 | 9/1983 | Miyanagi et al. | 175/27 |
| 4,646,854 | 3/1987 | Arndt et al. . | |
| 4,671,366 | 6/1987 | Uitto et al. . | |
| 4,800,797 | 1/1989 | Comarmond . | |
| 4,813,492 | 3/1989 | Biek | 173/2 |
| 4,848,485 | 7/1989 | Piipponen et al. | 175/27 |
| 4,898,251 | 2/1990 | Clark et al. | 175/27 |
| 4,899,836 | 2/1990 | Venot . | |
| 5,090,485 | 2/1992 | Pomonik et al. | 173/1 |

FOREIGN PATENT DOCUMENTS 1584810 2/1981 United Kingdom .

*Primary Examiner*—Frank T. Yost
*Assistant Examiner*—Scott A. Smith
*Attorney, Agent, or Firm*—Spencer, Frank & Schneider

[57] ABSTRACT

A control system for a hydraulic percussion mechanism (6) is based on the continuous measurement of the striking rate (z) of the striking piston, or on the continuous measurement of the striking rate (z) of the striking piston together with the quantity per unit time ($Q_e$) of the hydraulic driving medium coming into the percussion mechanism (6). One, or possibly both, of these parameters is measured from outside the percussion mechanism itself. The control system is configured in such a way that the internal resistance of the percussion mechanism or the hydraulic pump which powers it is increased if there is an increase in the striking rate (z) or the ratio z/Q of the striking rate to the incoming stream rate beyond respective limit values.

20 Claims, 9 Drawing Sheets

METHOD AND APPARATUS FOR ADAPTING THE OPERATIONAL BEHAVIOR OF A PERCUSSION MECHANISM TO THE HARDNESS OF MATERIAL THAT IS BEING POUNDED BY THE PERCUSSION MECHANISM

CROSS REFERENCE TO RELATE APPLICATION

This application claims the priority of an Application, Ser. No. P 40 36 918.8, filed Nov. 20, 1990 in Germany, the subject matter of which is incorporated herein by reference.

BACKGROUND OF THE INVENTION

The present invention relates to a method and apparatus for controlling a percussion mechanism which has a striking piston that performs back and forth movements under the influence of hydraulic driving medium furnished by a conveying unit, and more particularly to a method and apparatus for adapting the operational behavior of the percussion mechanism to the hardness of material that is being pounded (for the purpose, for example, of crushing the material) by the percussion mechanism. The percussion mechanism employed may (or may not) be one having an adjustable stroke.

Hydraulically operated percussion mechanisms form an operational chain with a conveying unit such as a hydraulic pump on one side and a tool (particularly a chisel) on the other side for crushing material. A stream of energy flows through this chain in each direction. The primary stream of energy is directed from the conveying unit through the percussion mechanism and the tool onto the material to be crushed (such as rock or stone). A secondary stream of energy may be reflected by the material being crushed and act through the percussion mechanism in the direction toward the conveying unit. The characteristics of the material being crushed and of the tool are expressed by a reflection factor R, which is an indirectly measurable value and is defined by the ratio of the primary striking energy to the reflected striking energy. The magnitude of the reflection factor may influence the energy balance and the characteristics (that is, the ratio of striking rate to the energy of each individual stroke) of the percussion mechanism.

To attain the greatest possible crushing performance, it would be desirable to adapt the operational behavior of a percussion mechanism in such a way that, with increasing hardness of the material (that is, with increasing magnitude of the reflection factor), the energy of each individual stroke increases. A reflection or rebound may occur if the energy in an individual stroke is too low. Such reflections are undesirable, since stresses on the tool and the percussion mechanism are high but the crushing performance is poor. In order to limit the stresses on the percussion mechanism, care should be taken that the number of striking piston strokes does not increase with increasing reflection of energy. Furthermore, for a percussion mechanism of the type having an adjustable stroke, care should be taken that an increase in the energy of each individual stroke due to an adjustment of the magnitude of the stroke is accompanied by a suitable reduction of the striking rate.

Various methods have been proposed to adapt the operational behavior of a percussion mechanism to the hardness of the material being crushed. These methods utilize the varying period of dwell of the striking piston in the vicinity of its theoretical striking position (see EP-B1-0,214,064, corresponding to U.S. Pat. No. 4,899,836 and EP-B1-0,256,955, corresponding to U.S. Pat. No. 4,800,797) or are based on electrical measurements of the vibrations in drill rods and derive therefrom an influence on the position of the advancing unit (see DE-A1-3,518,370, corresponding to U.S. Pat. No. 4,671,366). In the case of the first-mentioned method, a pressure fluctuation is initiated within the percussion mechanism as a function of the period of dwell and is utilized directly as a control value which adjusts the impact velocity and the striking rate as a function of the hardness of the material being crushed. An undesirable recoil of the striking piston due to insufficient energy of an individual stroke can be avoided at least substantially by means of a control change which influences the magnitude of the stroke of the striking piston (see DE-C3-2,658,455, corresponding to British patent 1,584,810).

Some of the above-mentioned proposals for a solution to the problem of adapting the operational behavior of a percussion mechanism to the hardness of the material being crushed are not suitable for rough working conditions, are susceptible to malfunction but are not easy to repair, and/or are sensitive to changes in the temperature and changes in viscosity of the hydraulic driving medium. This applies, in particular, for controls whose essential components are integrated in the percussion mechanism.

A prior art percussion mechanism which employs energy recovery when the tool rebounds due to the reflection factor is disclosed in European Patent Office Publication 0,183,093, corresponding to U.S. Pat. No. 4,646,854, and will be described below with reference to FIGS. 8–11.

Percussion mechanism 101 includes an operating cylinder 102 in which a percussion piston 103 is movably guided. At its lower end, percussion mechanism 101 is provided with a bit 104 which is held in a known manner so as to be able to slide a certain amount. The end of operating cylinder 102 facing bit 104 is connected, via a feed or pressure conduit 105, with a source of hydraulic driving medium (hydraulic fluid) at a pressure $P_0$. Facing the mouth of the inlet of pressure conduit 105 in operating cylinder 102, there is provided an annular groove 106. Percussion mechanism 101 is further equipped with an accumulator 108 which is connected with pressure conduit 105. The accumulator 108 may be designed as described, e.g., in U.S. Pat. No. 3,322,210 to Arndt.

Percussion mechanism 101 further includes a control valve 110 having a control cylinder 111 and a sleeve-like control slide 112 movable therein. Control cylinder 111 has three cylindrical parts, 111*a*, 111*b*, 111*c* (see FIG. 10), with center part 111*b* having the largest diameter, lower part 111*c* having the smallest diameter, and upper part 111*a* having a diameter which lies between the other two diameters. The front end of the lower cylindrical part 111*c* of control cylinder 111 is connected with pressure conduit 105 via branch conduit 113. The upper end of control cylinder 111 is connected, via an annular groove 115 and a conduit 116, with a return flow conduit 117 (hereinafter abbreviated as "return conduit") which leads to an essentially pressureless connection (symbol: $P_T$) for releasing to hydraulic fluid.

The lower part 111*c* of control cylinder 111 is additionally connected, via a lateral conduit 118, with the upper part of operating cylinder 102, with an annular groove 119 being provided in control cylinder 111 toward the opening of conduit 118 and an annular groove 120 in operating cylinder 102. In the vicinity of groove 119, control cylinder 111 is connected via annular groove 122 directly with return conduit 117.

Between grooves 106 and 120 in operating cylinder 102, a further annular groove 123 is provided which is connected with return conduit 117 via two conduits 124 and 125. Between grooves 106 and 123, operating cylinder 102 is provided with a control annular groove 126 through which operating cylinder 102 is connected with control cylinder 111 via a control channel or a control conduit 127.

Control conduit 127 is formed by the two conduits or conduit sections 127*a* and 127*b*. In control cylinder 111, control conduit 127 opens into an annular groove 129 disposed between grooves 115 and 122. The four grooves 115, 129, 122, and 119 of control cylinder 111 define its three cylindrical parts as follows: the upper cylindrical part 111*a* lies above groove 115, the center cylindrical part 111*b* is delimited by the two grooves 115 and 129, and the lower cylindrical part 111*c* extends from the lower edge of groove 129 to below groove 119. Groove 122 lies within lower cylindrical part 111*c*.

The two conduit sections 127*a* and 127*b* are connected together by means of a holding valve 130 provided with three connections, with the third connection being connected, via a conduit section 131 and conduit 125, with return conduit 117.

Percussion piston 103 has a tapered, front or lower section 132 and a rear or upper section 133, with the diameter of front section 132 being greater than the diameter of rear section 133. Sections 132 and 133, respectively, are provided with a small annular face 134 and a large annular face 135, respectively. Between the two annular faces 134 and 135 there is disposed a recess or circumferential groove 136, forming two piston collars 137 and 138, respectively. When ready for Operation, the small annular face 134 is constantly charged with a hydraulic fluid such as oil through pressure conduit 105. With its end adjacent circumferential groove 136, piston collar 137 forms an upper control edge 139 and with its end formed by the smaller annular face 134, it forms a lower control edge 140.

At its lower end facing branch conduit 113, control slide 112 is equipped with a first cylindrical section 141 having a first frontal face 142 and at its opposite end, it has a second cylindrical section 143 having a second frontal face 144. The diameter of first section 141 is smaller than the diameter of second section 143, so that first frontal face 142 also is smaller than second frontal face 144. In the operational state, both frontal faces 142 and 144 are constantly under pressure so that, via these faces, a downwardly directed force constantly acts on control slide 112, with this force resulting from the difference between surface areas ($A_{44}-A_{42}$) multiplied by the operating pressure $P_0$. Between sections 141 and 143 there is a piston collar 145 having an annular or control face 147 which is associated with first section 141 and a correspondingly smaller annular face 148 which is associated with second section 143. The space between groove 115 of control cylinder 111 and the second cylindrical section 143 of control slide 112 is always connected with return conduit 117.

The first section 141 of control slide 112 is guided in lower cylindrical part 111*c* and the second section 143 is guided in the upper cylindrical part 111*a* of control cylinder 111. Piston collar 145 slides in the center, cylindrical portion 111*b* of control cylinder 111.

The first cylindrical section 141 has a circumferential groove 149 and—between it and control face 147 —a small radial auxiliary bore 151. The length of circumferential groove 149 is greater than the distance between the two grooves 119 and 122 in control cylinder 111.

In FIG. 9, holding valve 130 is shown to an enlarged scale. It is comprised of a hollow cylindrical cavity or bore 153 and a valve body in the form of a sphere 154. Cylindrical cavity 153 is provided with a valve seat 155 at its frontal face which is connected, via conduit section 131, with return conduit 117 and, at its other frontal face, which is connected with conduit section 127*a*, cylindrical cavity 153 is provided with a valve seat 156. Conduit section 127*b* of control section 127 opens radially into cylindrical cavity 153. If sphere 154 rests against valve seat 155, the center axis of conduit section 127*b* goes through the half of sphere 154 facing this valve seat. The diameter of sphere 154 is smaller than the diameter of cylindrical cavity 153 so that the hydraulic fluid is able to flow through the gap 158 formed by sphere 154 and bore 153.

The operation of percussion mechanism 101 will be described below for the case where the energy applied to bit 104 by percussion piston 103 is transferred completely to the pulverized material and is not reflected. FIG. 8 shows percussion mechanism 101 during the operating stroke of percussion piston 103. Above the large annular face 135, cylinder 102 is connected via conduit 118 and branch conduit 13 with pressure conduit 105. Percussion piston 103 is thus accelerated toward bit 104 by a force which is the result of the surface area difference ($A_{35}-A_{34}$) multiplied by the operating pressure $P_0$. During the striking or operating stroke, control slide 112 is in the upper position facing away from high pressure conduit 105 and branch conduit 113, respectively. Hydraulic fluid can flow through auxiliary bore 151 into the area below control face 147 and maintains the pressure existing there (conduit section 127*a* is covered by piston collar 137 and conduit 131 leading to return conduit 117 is covered by sphere 154 resting against the left valve seat 155). Since annular face 148 is without pressure and control face 147 is larger than the downwardly acting partial surface or difference between surface areas ($A_{44}-A_{42}$), control slide 112 remains in its upper position.

Shortly before piston 103 abuts on bit 104, the upper control edge 139 reaches control groove 126. Circumferential groove 136 connects conduit section 127*a*—and thus the entire control conduit 127—via conduit 124 with return conduit 117, so that the area below control face 147 becomes free of pressure. Thus the force composed of the partial area or surface area difference ($A_{44}-A_{42}$) is the exclusive force acting on control slide 112 and, during a valve or control period $t_{st}$, presses control slide 112 from its upper position (illustrated in FIG. 8) to its lower position (illustrated in FIG. 10). This causes the (pressure-free) hydraulic fluid to be pressed through conduit section 127*b* which, when it enters cylindrical cavity 153 of holding valve 130, impinges on the left portion of sphere 154 and flows through the gap 158 formed by sphere 154 and cavity 153 and through conduit section 127*a* to return conduit 117. The pressure difference appearing at gap 158 drives sphere 154 to the right toward valve seat 156. For a short time, the hydraulic fluid which flows out through conduit section 127*b*, can also flow out through conduit section 131 and through conduit section 127*a* as well as through conduit 124 to conduit 125 and thus to return conduit 117. If sphere 154 rests against valve seat 156, and conduit section 127*a* and conduit 124 are thus blocked for the hydraulic fluid flowing out of conduit section 127*b*, the hydraulic fluid that is displaced from control face 147 and that is being fed in through auxiliary bore 151 can continue to flow out, against a slight drop in pressure in conduit section 131, to conduit 125 and thus to return conduit 117.

While control slide 112 is being moved into its lower position, auxiliary bore 151, on the one hand, is covered by that part of control cylinder 111 which is disposed between grooves 129 and 122, and circumferential groove 149, on the other hand, connects annular face 135 of piston 103 via grooves 122 and 119 as well as conduit 118 with return conduit 117 (see FIG. 10). The upper, large annular face 135 is thus relieved and percussion piston 103 is accelerated upwardly for its return stroke by the force acting on the lower, small annular face 134. Toward the end of the return stroke, the lower control edge 140 in the form of the smaller annular face 134 reaches control groove 126 and thus reestablishes a connection between pressure conduit 105 and conduit section 127*a* of control conduit 127. Sphere 154 is pressed toward the left valve seat 155 (compare FIG. 11) and the entire control conduit 127 as well as the area below control face 147 is charged with pressure so that control slide 112 is moved back into its upper position in which it reconnects, via connection conduit 113, conduit 118—which leads to operating cylinder 102—with pressure conduit 105 and initiates a new operating stroke.

For the case that the energy transmitted from percussion piston 103 to bit 104 is at least partially reflected, the reflected pulse suddenly accelerates piston 103 in the direction of the return stroke so that the time between the opening of control groove 126 via circumferential groove 136 and conduit 124 to return conduit 117 during the downward stroke of piston 103 and reclosing of control groove 126 by the upper control edge 139 is too short to bring control slide 112 into its lower position.

A small downward movement of control slide 112 may possibly be initiated but, when control groove 126 is prematurely closed because of the reflection, so that hydraulic fluid is prevented from flowing from conduit section 127*a* to conduit 124, this initial downward movement is cancelled out because auxiliary bore 151 communicates hydraulic fluid into the area below control face 147.

The short time between the opening of control groove 126 by the upper control edge 139 and the premature reclosing of groove 126 when piston 103 jumps back is, however, sufficient to lift sphere 154 from the left valve seat 155 and move it to the right. But this connects conduit section 127*b* with return conduit 117 via conduit sections 131 and 125. This connection remains intact even if control groove 126 is closed again. Control slide 112 thus performs its change of position in the same manner and during nearly the same valve or control period $t_{st}$ as if percussion piston 103 were to release all of its energy without reflection to bit 104 and remain in the impact position S-S.

Within the control or valve period $t_{st}$, i.e. within the period running from the connection of the annular control groove 126 by the circumferential recess 136 via the conduit 124 to the pressureless return conduit 117 to that moment, when the control slide 112 has reached its lower position, the pressurized fluid ahead of the large annular area 135 within the operating cylinder 102 and being pushed upwards by the percussion piston 103 (which in turn is reflected or moved upwards by bit 104) can flow off through the conduits 113 and 118 into the accumulator 108. The control period $t_{st}$ is structurally selected in such a manner that, in the case of a reflection of the striking energy, the pressurized fluid being pushed upwards can flow off into the accumulator 108 essentially completely; that means that this energy is thereby additionally available at the following stroke. For that purpose the control or valve period $t_{st}$ may be influenced or modified by the areas $A_{47}$ and $A_{48}$ of the control face 147 and of the annular face 148, respectively, whereby the control period $t_{st}$ is inversely proportional to the square root of the area difference $(A_{47}-A_{48})$. Further elements for modifying the control period $t_{st}$ are the stroke $s_{12}$ and the mass $m_{12}$ of the control slide 112 as well as the operating pressure $P_0$, whereby the control period $t_{st}$ is linear or proportional to the root of the stroke $s_{12}$ and to the root of the mass $m_{12}$ and reversely proportional to the root of the operating pressure $P_0$. For further modifying the control period $t_{st}$ the operating pressure may be reduced by an adjustable throttle valve as described, e.g., in British Patent 1,584,810.

The hydraulic fluid flowing into pressure reservoir 108 is available for the next percussion stroke and has the same effect as an increase in the conveyed quantity $Q_0$ of fluid. Since the striking rate z of percussion piston 103 is proportional to the conveyed quantity $Q_0$, the availability or recovery, respectively, of the reflected energy also increases the striking rate z and thus the entire output of percussion mechanism 101.

In modification of the described embodiment, control slide 112 can also be charged by a pressure spring in the direction towards its lower position, as disclosed, for example, in European Patent Application A1 0,070,246.

The operation of percussion mechanism 101 as described above can be summarized as follows: When piston 103 is in its upper position (the position of piston 103 in FIG. 10), an upward force is exerted on control slide 112 because the region beneath control face 147 is effectively exposed to pressure conduit 105. However when control slide 112 is in its upper position (the position of slide 112 in FIG. 8), a downward force is exerted on piston 103 because conduit 118 is effectively connected to connected to pressure conduit 105. The result is that piston 103 begins moving downward, while slide 112 remains biassed in its upper position. When piston 103 is near its lower position (not illustrated), however, its recess 136 connects conduit section 127*a* to conduit 124. This effectively exposes the region beneath face 147 to return conduit 117, despite a slight flow of fluid through bore 151, so that slide 112 begins moving toward its lower position (the position of slide 112 illustrated in FIG. 10). When it reaches its lower position slide 112 effectively disconnects conduit 118 from pressure conduit 105 and exposes it instead to return conduit 117, so that large face 135 gets pressure-free and the operating pressure $P_0$ on face 134 of piston 103 begins moving piston 103 back to its upper position to begin the cycle anew. This operation occurs even if piston 103 rebounds when it strikes bit 104, so that conduit section 127 is disconnected from conduit 124 before slide 112 reaches its lower position. The reason for this is that sphere 154 is lifted from valve seat 155 as soon as conduit section 127*a* is connected to conduit 124 on the downward stroke of piston 103, thereby effectively connecting the region beneath face 147 to return conduit 117 until piston 103 regains its upper position.

Further information concerning percussion mechanism 101 can be found in U.S. Pat. No. 4,646,854, which is incorporated herein by reference.

SUMMARY OF THE INVENTION

It is an object of the present invention to provide a method and an apparatus for use with a hydraulically driven percussion mechanism to automatically adapt the percussion mechanism's operational behavior to the hardness of the material being crushed, with the significant and essential components (particularly sensors and controllers) of the apparatus preferably being arranged independently of the percussion mechanism. This makes them more reliable in operation and more repair-friendly. They can then also be used with differently configured percussion mechanisms.

The method and the apparatus should be such that the energy of each individual stroke required to crush the material is automatically adapted to the (changeable) hardness of the material being crushed. If, for structural reasons, it is not possible to adapt the energy of each individual stroke, the striking energy recovered by the reflection processes should be prevented from undesirably increasing the striking rate of the striking piston.

These and other objects which will become apparent in the ensuing detailed description can be attained by providing method for adapting the operational behavior of a percussion mechanism (including one equipped with stroke adjustment) to the hardness of the material to be crushed, which method is characterized in that, of the two characteristic performance values of the percussion mechanism determined outside the percussion mechanism—the quantity per unit time ($Q_e$) of the stream of hydraulic driving medium coming into the percussion mechanism from a conveying unit and the striking rate (z) of the striking piston of the percussion mechanism, which performs back and forth movements under the influence of the driving medium—at least the latter is employed as a measured value which is converted in a control system into a control instruction and is caused to influence an adjustment member with which the internal resistance of one of the two operational units—the conveying unit and the percussion mechanism—is changed in such a manner that the internal resistance is increased if there is an increase in the at least one measured value to an adjustable, desired characteristic performance value—with which a limit value is given that at least covers the striking rate.

In deviation from the prior art, the basic concept of the invention is to establish the control for adapting the operational behavior on the basis of at least one measuring process which is conducted outside of the percussion mechanism. The measured parameter(s) are the striking rate of the striking piston, or the striking rate and the quantity of the hydraulic driving medium streaming into the percussion mechanism per unit time (that is, the rate at which the driving medium enters the percussion mechanism). The measurements lead to a control instruction which is utilized to vary the internal resistance of one of the two interacting operational units, namely the conveying unit or the percussion mechanism. If the striking rate, or if a characteristic performance value formed of the values measured for the striking rate and the quantity of driving medium flowing in per unit time, increases to an adjustable limit value, the internal resistance of one of the two operational units is increased. In percussion mechanisms operating with a non-adjustable stroke, this results in the striking rate being reduced. In percussion mechanisms operating with an adjustable stroke, the energy of each individual stroke is increased by increasing the magnitude of the stroke.

The present invention takes advantage on the known phenomena that the striking rate of a percussion mechanism changes with the characteristics of the material being crushed (that is, the striking rate increases with increasing magnitude of the reflection factor) and that the ratio of the striking rate to the quantity flowing in per unit time increases with the magnitude of the reflection factor.

The values to be measured, that is, the striking rate and possibly also the quantity of driving medium flowing into the percussion mechanism per unit time, can be detected by means of known sensors which measure sound waves or vibrations that are indicative of the striking rate or which measure flow, and can be converted into a regulating instruction.

In the simplest case, the internal resistance of the percussion mechanism can be increased by changing the pressure in the return conduit (return movement resistance) against which the striking piston performs the return stroke. This can be done, for example, using a choke valve which determines the cross-sectional area of the return conduit, the choke valve being adjusted on the basis of control instructions derived from the measured striking rate value. If, with increasing magnitude of the reflection factor, the value measured for the striking rate rises to a predetermined limit value, the return movement resistance is increased by way of the control instruction obtained from this measured value, thus reducing the maximum return stroke velocity of the striking piston, that is, the velocity at the start of the return stroke. Such a reduction of the maximum return stroke velocity limits an increase in the striking rate.

However, the adaptation of the operational behavior of the percussion mechanism to changes in the hardness of the material being crushed may also be brought about by influencing the internal resistance of the conveying unit. By definition, its internal resistance increases if, due to a decrease in the volume of driving medium available for conveyance per unit time, the exiting stream from the conveying unit is reduced in size. If the value measured for the striking rate increases to the predetermined limit value, a control instruction causes the conveyed stream of driving medium to be reduced until the striking rate has again reached the predetermined limit value.

For a percussion mechanism with an adjustable stroke, the incoming quantity of driving medium received per unit time by the percussion mechanism may also be determined. The ratio of the striking rate and the rate at which the driving medium enters the percussion mechanism can then be used as a measured value. If this measured value rises to a limit value which is predetermined as a function of the magnitude set for the stroke of the percussion mechanism, the internal resistance of the percussion mechanism is raised by adjusting the magnitude of the stroke.

Since the ratio increases if the magnitude of the reflection factor also increases, an increase in the magnitude of the percussion mechanism's stroke, initiated by a control instruction, results in a corresponding change in the energy of each individual stroke acting on the material being crushed. The limit value applicable in such a case is adapted to the momentarily set magnitude of the stroke of the percussion mechanism; consequently, the method operates with an adjustable measured value ratio limit value.

The above described embodiment of the method may further include a striking rate limit value which is predetermined as a function of the set magnitude of the percussion mechanism stroke. This ensures that the striking rate always returns to below the associated striking rate limit value for the range determined by the magnitude of the percussion mechanism stroke.

Insofar as it is possible to influence the magnitude of the stream of hydraulic driving medium being conveyed by an adjustment of the volume available for conveyance per unit time, the stream can be reduced, possibly in addition to other measures, if the operating pressure in the conveyed stream rises to a predetermined pressure limit value. In this embodiment, the operating pressure existing in the stream being conveyed is detected by means of a pressure sensor and is converted into a control value in a pressure controller. If an adjustment in the stroke is provided, the pressure limit value will advisably be predetermined as a function of the respectively set magnitude of the percussion mechanism stroke. This makes it possible to adapt the pressure limit value to different ranges determined by the magnitude of the percussion mechanism stroke. A percussion mechanism with adjustable stroke is disclosed in the already-mentioned publication DE-C3-2,658,455, corresponding to British patent 1,584,810. According to that reference, the stroke of the striking piston can be varied by means of a spring charged control valve which—in dependence on the magnitude of a control pressure charging it—releases or blocks differently arranged control grooves and control channels and thus influences a change in the movement of the striking piston. The magnitude of the control pressure, which can be determined easily by a pressure sensor, thus corresponds to a certain magnitude of the respectively set striking piston stroke.

The significant components of an apparatus suitable for implementing the method are a striking rate sensor which detects the striking rate of the striking piston and is disposed outside of the percussion mechanism; a striking rate regulator connected to its output; and an adjustment member controlled by the striking rate regulator for increasing the internal resistance of the conveying unit or the percussion mechanism if the measured striking rate value increases to a predetermined limit value.

The adjustment member may be composed of an adjustable choke that is incorporated in the return conduit of the percussion mechanism. It may alternatively be configured as an adjustment drive by means of which the volume of hydraulic driving medium available for conveyance per unit time in the conveying unit can be adjusted.

A different type of apparatus for implementing the method includes two sensors disposed outside the percussion mechanism. One sensor is a striking rate sensor for detecting the striking rate of the striking piston and the other sensor is an incoming stream sensor for determining the quantity of driving medium streaming into the percussion mechanism per unit time. Further essential components of this apparatus are a calculating member for forming the ratio (z/Q) between the striking rate and the rate that the driving medium flows into the percussion mechanism, a controller for processing the z/Q value, and an adjustment member connected to the output of the controller for influencing the internal resistance of the percussion mechanism. The latter is increased under the influence of the controller if the actual value of the ratio rises to a predetermined, variable limit value.

A modification of the embodiment discussed above is characterized in that the magnitude of the stroke of the percussion mechanism is adjustable (normally in stages) by way of the adjustment member. The internal resistance of the percussion mechanism can be raised in this case by lengthening the stroke of the percussion mechanism.

An adjustable choke controlled by a striking rate controller may be incorporated in the return conduit of the percussion mechanism in the embodiment and modification thereof discussed above in the last two paragraphs. The striking rate controller connected to the output of the striking rate sensor is configured in such a way that it becomes effective only if the value measured for the striking rate rises to a limit value which is predetermined as a function of the respectively set magnitude of the percussion mechanism stroke. The striking rate controller ensures that the striking rate is always lowered below a limit value that is adapted to the magnitude of the momentarily set percussion mechanism stroke.

The apparatus may additionally include a pressure sensor which detects the operating pressure in the conveying conduit of the conveying unit, a pressure regulator connected to its output, and an adjustment drive controlled by the pressure regulator in such a manner that the volume of driving medium available per unit time for conveyance in the conveying unit is decreased if the operating pressure rises to a predetermined pressure limit value. A change in the operating pressure of the conveying conduit produced by changing operating conditions therefore causes the volume available per unit time for conveyance in the conveying unit to be correspondingly adapted. A further adaptation to the respective range of operation of the percussion mechanism can be brought about if the pressure limit value is predetermined as a function of the magnitude set for the percussion mechanism's stroke. This can be done using a pressure limit value generator which determines the previous magnitude set for the percussion mechanism's stroke. In such an embodiment, the pressure limit value is thus also adapted to the momentarily set magnitude of the stroke of the percussion mechanism.

DESCRIPTION OF THE PREFERRED EMBODIMENT

Figure 1:
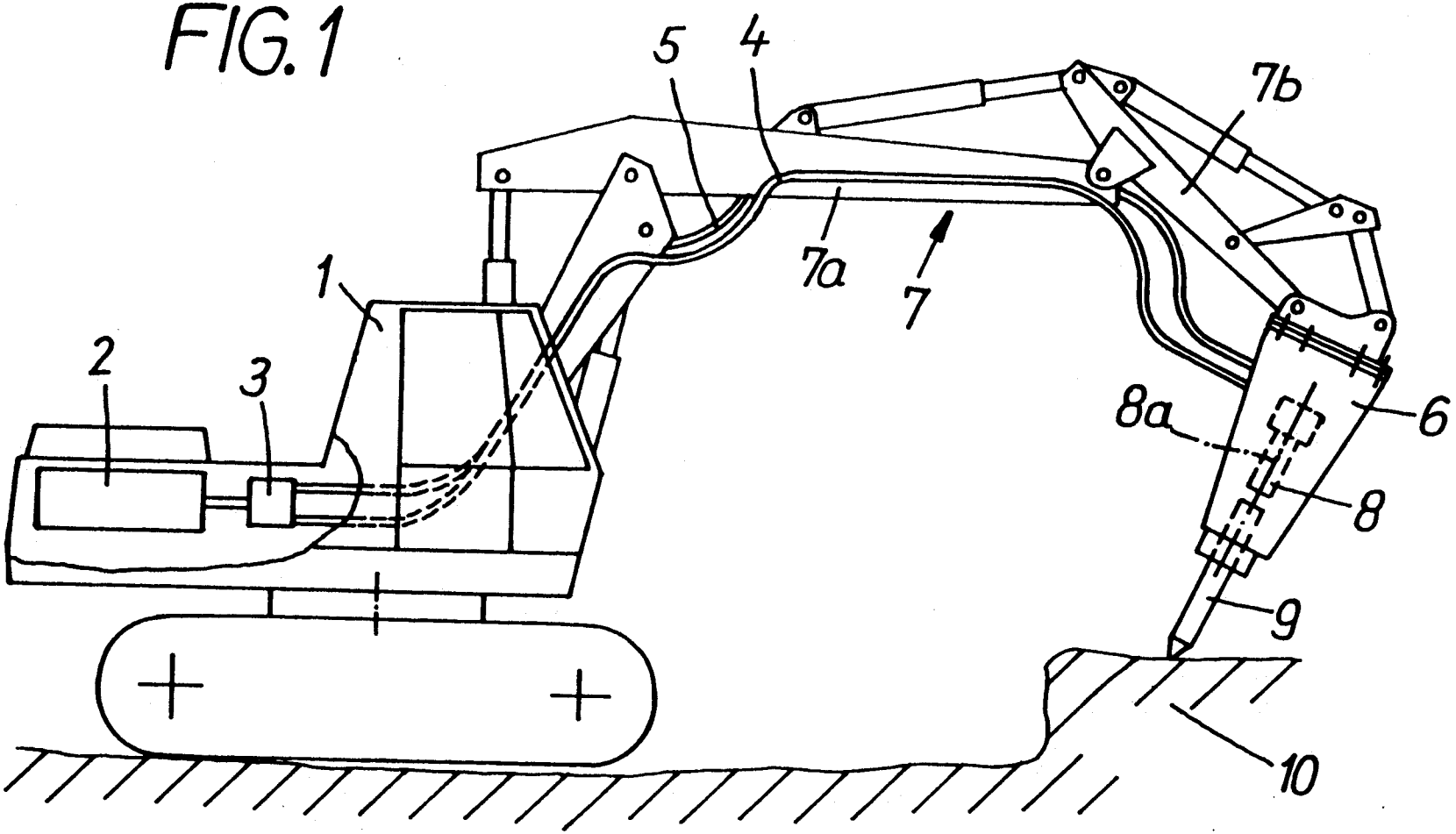
FIG. 1 is a schematic representation of a hydraulic excavator which includes a percussion mechanism in the form of a hydraulic hammer.

The hydraulic excavator 1 shown in FIG. 1 includes, as a supply unit, a Diesel engine 2 which drives, among other mechanisms, an operational unit in the form of a hydraulic pump 3. Hydraulic pump 3 is connected by way of a pressure conduit 4 and a return conduit 5 with another operational unit in the form of a hydraulic hammer 6. Hammer 6 is held in a controllable manner by a boom 7, which includes two articulated arms 7*a* and 7*b*.

Under the influence of the stream of hydraulic driving medium supplied through pressure conduit 4, the striking piston 8 of the hydraulic hammer 6 performs a reciprocating movement in the direction of its longitudinal axis 8*a*. At the end of its stroke, the piston 8 impacts on a tool in the form of a chisel 9 and acts by way of the latter on material 10 which is being pounded, in this case for the purpose of crushing or breaking it. The motion energy of striking piston 8 is converted into striking energy.

Preferably, a percussion mechanism which employs energy recovery is used as hammer 6. Such a percussion mechanism is disclosed in European Patent Office Publication 0,183,093, corresponding to U.S. Pat. No. 4,646,854, and was described in the "Background of the Invention" section of this document with reference to FIGS. 8–11. This type of configuration provides that, after impact and during the return stroke, the striking piston is temporarily still connected to the pressure conduit carrying the operating pressure.

Figure 2:
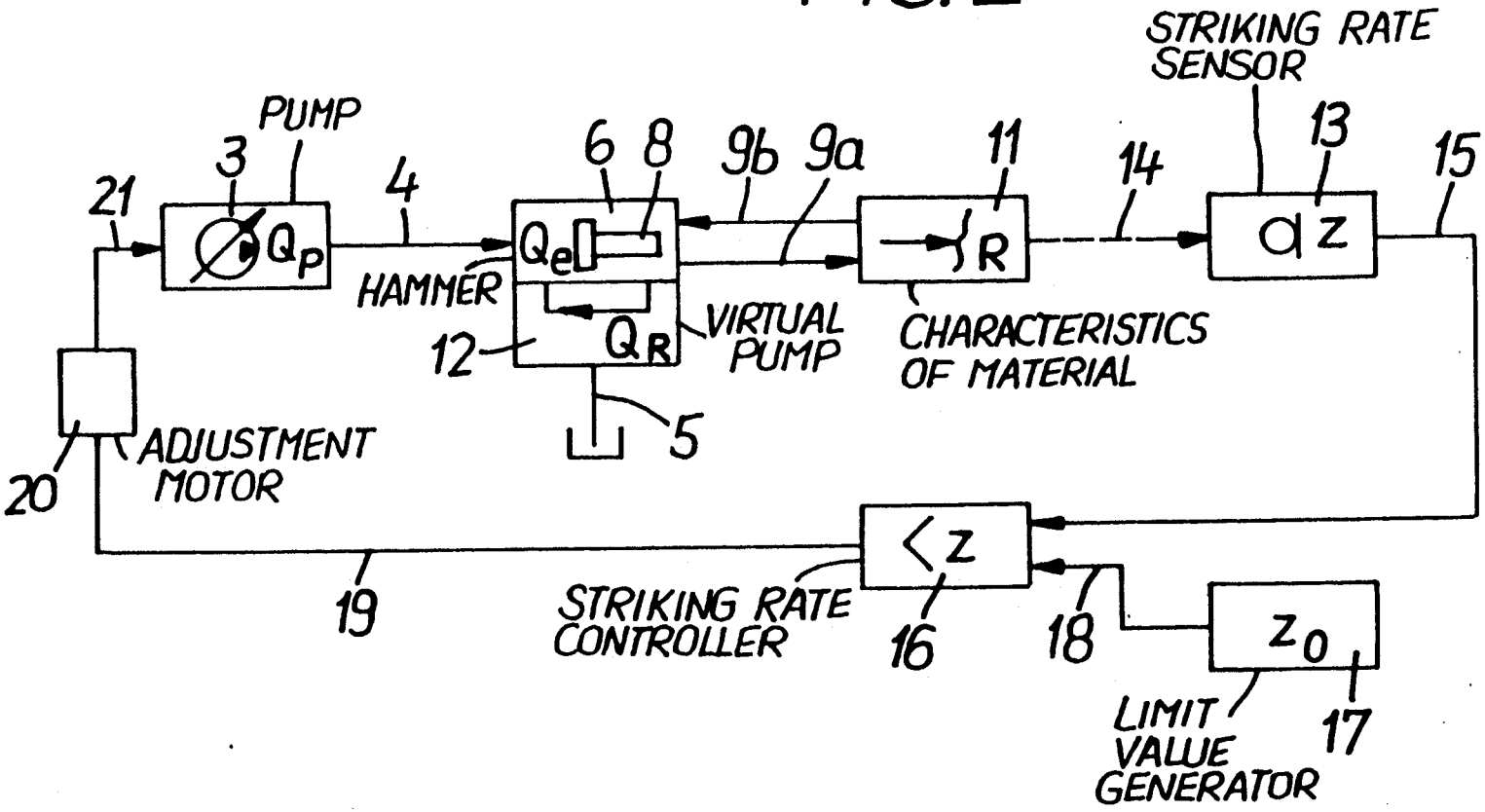
FIG. 2 is a block circuit diagram of an apparatus including a variable displacement pump as the conveying unit with which the continuously determined measured value of the striking rate of the striking piston can be kept almost constant if required.

In the illustration of FIG. 2 (and also in FIGS. 3 to 5), the energy transferred through chisel 9 (see FIG. 1) is represented by two action arrows 9*a* and 9*b*. The different characteristics of the material 10 to be crushed are indicated by a block 11 in which R is the reflection factor.

Hydraulic pump 3 conveys a stream of hydraulic driving medium at a rate (quantity per unit time) designated by $Q_p$. The conveyed stream travels at an operating pressure through pressure conduit 4 to hydraulic hammer 6, which receives the incoming driving medium at a rate (quantity per unit time) designated by $Q_e$, and converts the energy by means of the striking piston 8 into hydraulic striking energy.

Energy that may be recovered within the hydraulic hammer 6, if the striking energy is not totally absorbed by the material and rebounding of the chisel 9 occurs due to the reflection factor R, is indicated by a virtual pump 12 which converts the recovered mechanical energy into hydraulic energy by providing a reflected stream of driving medium at a rate $Q_R$. The reflected stream corresponds to the stream flowing into pressure reservoir 108 in the percussion mechanism discussed above with reference to FIG. 8–11, and acts as an addition to the stream $Q_e$ flowing into the input port of hammer 6.

The reflected stream $Q_R$ increases with the magnitude of the reflection factor R. If the reflection factor has the value of zero, virtual pump 12 correspondingly does not furnish any reflected stream $Q_R$.

The arrow 9*a* directed toward the right symbolizes the primary stream of energy emanating from the hydraulic hammer 6, and the arrow 9*b* represents the reflected stream of energy acting on the hydraulic hammer 6 and possibly resulting in the generation of a reflected stream $Q_R$. If the reflection factor R of the material 10 being crushed (see FIG. 1) does not have a value of zero, the incoming stream $Q_e$ received by hydraulic hammer 6 is smaller than the conveyed stream $Q_p$ furnished by hydraulic pump 3. Unless countermeasures are taken, this operational state causes the operating pressure in pressure conduit 4 to rise.

In order to adapt the operational behavior of hydraulic hammer 6 to a changing value in the reflection factor R, the apparatus in question is equipped, according to the teachings of the present invention, with a striking rate sensor 13 which is disposed outside of the hydraulic hammer. This striking rate sensor, which operates in the manner of a sound wave or vibration pickup detects—as indicated by a broken line 14—the sound waves or vibrations generated by the operation of the hydraulic hammer 6 as a function of the striking rate and converts them into a measured value z. The measured value z is fed through a measuring line 15 to a striking rate controller 16. The latter also receives, by way of a limit value generator 17 and a line 18, an adjustable striking rate limit value $z_0$.

Although not shown, the striking rate sensor 13 may include a microphone to detect the noise generated by hammer 6, an amplifier following the microphone, a low-pass filter which eliminates frequencies above the highest possible striking rate (so that what remains is a very low frequency signal corresponding to the reciprocation of hammer 6), a full-wave rectifier to convert the very low frequency signal to a pulsating DC signal, a storage capacitor which is charged by the pulsating DC signal, and a resistor across the capacitor to slowly bleed off the charge stored therein. As a result, the voltage across the capacitor represents the short-term average of the striking rate (z). Striking rate controller 16 may be a comparator. Limit value generator 17 may be a resistor and a potentiometer series-connected between a voltage source and ground to provide a voltage divider, the output of which ($z_0$) can be set by adjusting the potentiometer.

The output of striking rate controller 16 is connected via a control line 9 with an adjustment member in the form of an adjustment motor 20. The conveyance volume per unit time (i.e., the conveyance rate) of hydraulic pump 3 can be varied by means of adjustment motor 20, as indicated by a line 21. In the present case, hydraulic pump 3 is thus configured as a variable displacement pump. If the striking rate z determined as a measured value rises to the predetermined striking rate limit value $z_0$ during operation of hammer 6, striking rate controller 16 generates a control instruction that is transmitted to adjustment motor 20. The control instruction switches on the power supply (not illustrated) for motor 20, which then adjusts the pump 3 so that it reduces its conveyance rate Qp until the striking rate z has dropped again below the predetermined striking rate limit value $Z_0$.

The embodiment of the invention under discussion here thus makes it possible to adapt the operational behavior of the percussion mechanism to changing characteristics in the material being crushed, as embodied by reflection factor R, on the basis of a continuing determination of the magnitude of the striking rate. The striking rate sensor 13 may be configured in a known manner and may be disposed outside the hydraulic hammer—for example in an environment that is essentially free of shocks and vibrations. The advantage realized thereby is that the apparatus under discussion can be employed independently of the configuration of the hydraulic hammer.

Figure 3:
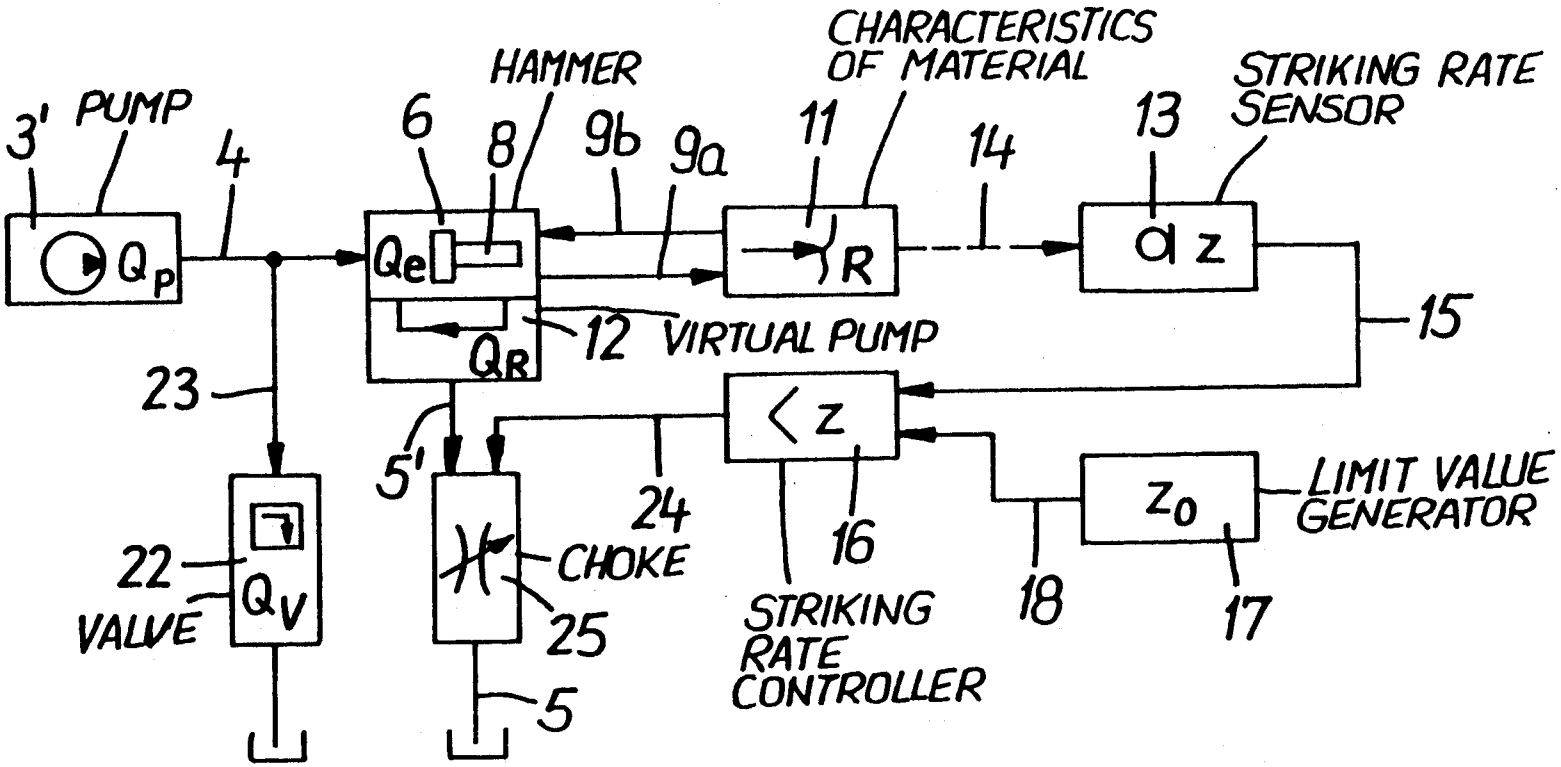
FIG. 3 is a block circuit diagram for a device by means of which the return movement resistance of the percussion mechanism is varied, if required, as a function of the continuously determined measured value of the striking rate.

In the embodiment of the present invention according to FIG. 3, hydraulic hammer 6 is connected by way of pressure conduit 4 to a hydraulic pump 3 having a constant conveying rate $Q_p$. An undesirable rise in the operating pressure in the pressure conduit 4 is prevented by a pressure limiting valve 22 whose connecting conduit 23 starts at pressure conduit 4.

In contrast to the previously described embodiment, a control line 24 connects the output of striking rate controller 16 with an adjustment choke 25 (or, more accurately, with a switch for turning on a solenoid to actuate choke 25). Choke 25 is built into the return conduit 5' of hydraulic hammer 6. By actuating the adjustment choke, it is possible to change the return movement resistance (and thus the return movement pressure in return conduit 5'), with the result that the velocity of the return stroke of striking piston 8 changes.

If the striking rate z, which is continuously determined by striking rate sensor 13, rises to the predetermined striking rate limit value $z_0$, adjustment choke 25 performs a closing movement under the influence of a control instruction generated by striking rate controller 16. This increases the internal resistance of hydraulic hammer 6, and the movement of striking piston 8 is retarded until the value measured for striking rate z falls below the limit value.

In the embodiment under discussion, a change in the reflection factor R can be detected by continuously monitoring the striking rate and may result in a change in the internal resistance of the hydraulic hammer, with a resulting reduction in the striking rate. The rising pressure in pressure conduit 4 might cause pressure limiting valve 22 to open and a partial stream $Q_V$ may begin to flow out.

Figure 4:
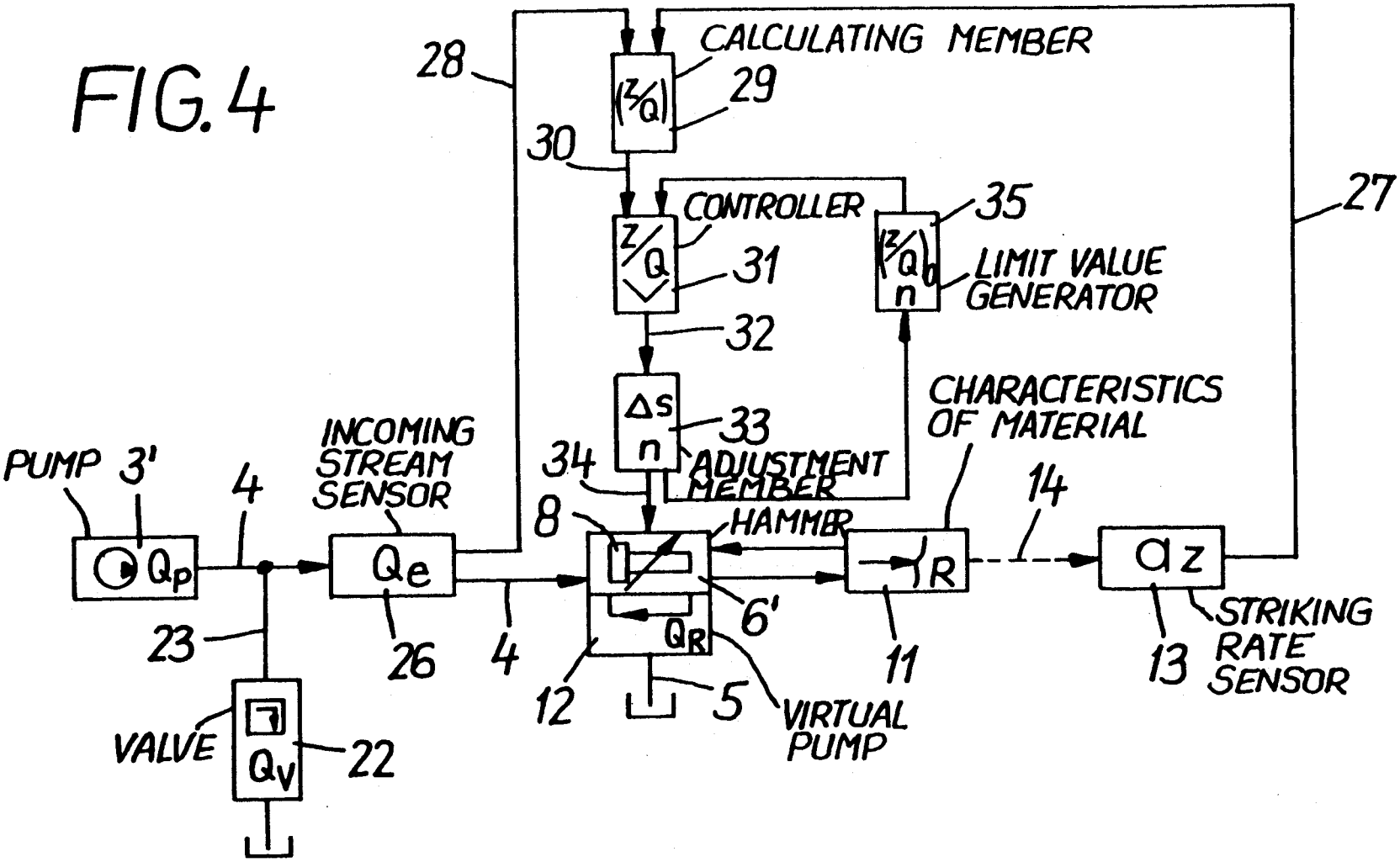
FIG. 4 is a block circuit diagram for an apparatus in which a control instruction is derived from a limit value and from values measured for the piston striking rate and the incoming stream rate of the hydraulic driving medium so as to change, if required, the magnitude of the stroke of the percussion mechanism.

In the apparatus according to FIG. 4, the control for adapting the operational behavior of hydraulic hammer 6 is based on two continuously measured parameters, namely the striking rate z picked up by striking rate sensor 13 and the flow rate $Q_e$ into hydraulic hammer 6 as detected by an incoming stream sensor 26. The incoming stream sensor, which operates in a known manner like a flow meter, is installed in pressure conduit 4 between hydraulic hammer 6 and the connecting conduit 23 for pressure limiting valve 22. The values obtained by sensors 13 and 26 (i.e., the striking rate z and the incoming stream rate $Q_e$) are fed by way of control lines 27 and 28 to a calculating member 29, which calculates the ratio z/Q between the two values. Although not shown, calculating member 29 may include a logarithmic amplifier which receives the output of sensor 26, another logarithmic amplifier which receives the output of sensor 13, a differential amplifier which subtracts the outputs of the logarithmic amplifiers, and an antilogrithmic amplifier which receives the output of the differential amplifier, this output corresponding to the ratio z/Q. This ratio is itself a measured value, which is transmitted by way of an input 30 to a controller 31. The latter in turn is in communication by way of a control line 32 with an adjustment member 33 by means of which the magnitude of the stroke of the percussion mechanism can be varied as indicated by an arrow 34. The embodiment under discussion thus requires the use of an adjustable stroke hydraulic hammer 6'. A change Δs in the stroke of the percussion mechanism may take place in a known manner in several stages indicated as "n" (see in this connection the already-cited DE-C3-2,658,455).

Figure 12:
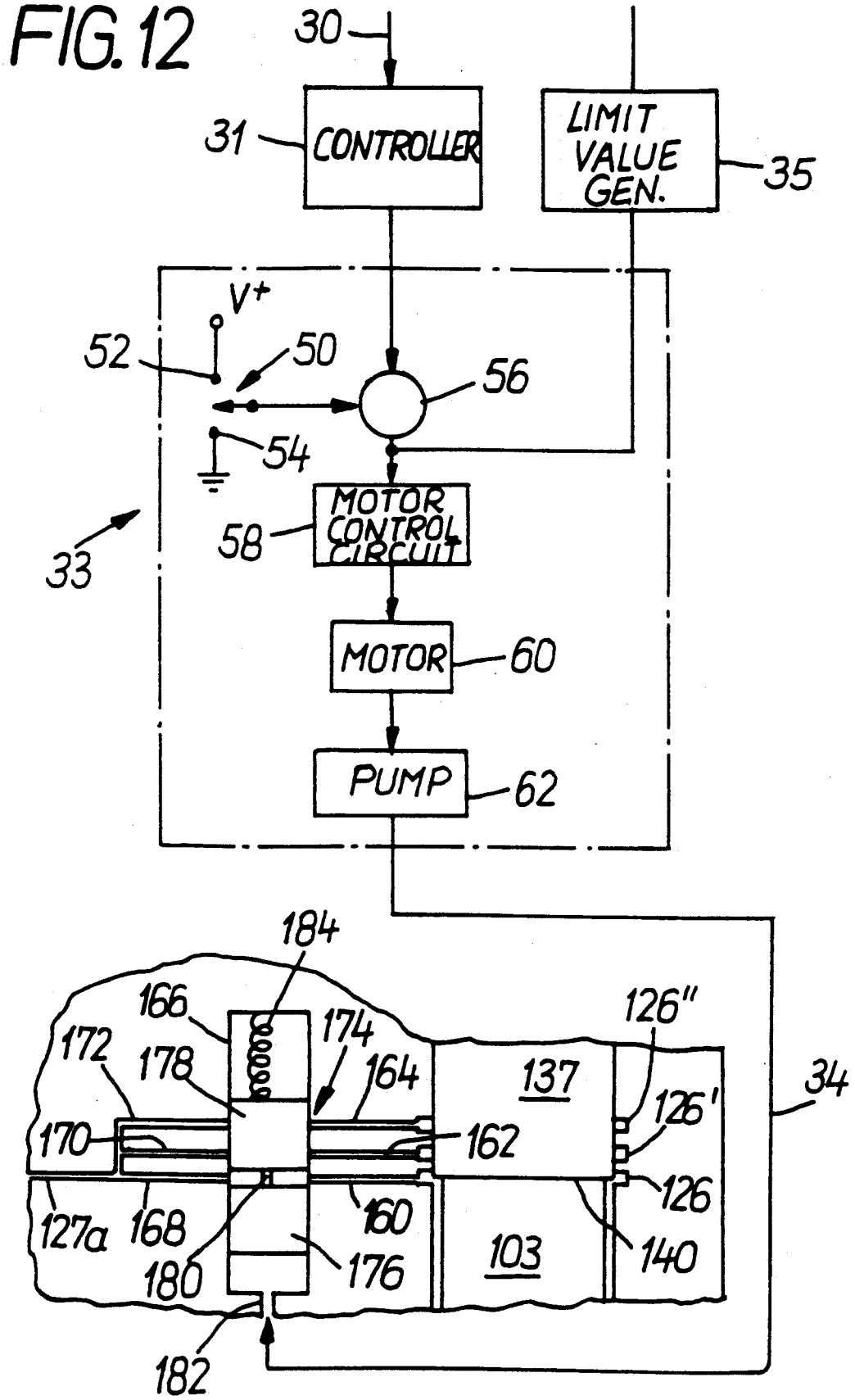
FIG. 12 is a sectional view schematically illustrating a portion of the percussion mechanism, modified to permit adjustable stroke magnitude, along with a block diagram of an adjustment member used to set the stroke magnitude.

The arrangement shown in British patent 1,584,810, which corresponds to DE-C3-2,658,455, can be adapted to the percussion mechanism illustrated in FIGS. 8–11 (and described in the "Background of the Invention" portion of this document) as shown in FIG. 12. Here, annular grooves 126' and 126'' have been added adjacent groove 126. Conduits 160, 162, and 164 connect grooves 126–126'' to a bore 166. Conduits 168, 170, and 172 also communicate with bore 166, each of these conduits also being connected to conduit **127*a* (which leads to holding valve 130 in FIG. 8). A two-part piston 174, having portion 176 and 178 which are joined by a rod 180, is slidably disposed in bore 166. One end of bore 166 is connected to a stroke control conduit 182. A spring 184 presses against piston portion 178. It will be apparent that the position of piston 174 can be controlled by controlling the pressure of hydraulic fluid in conduit 182. At zero pressure conduits 160 and 168 are connected via the gap between piston portions 174 and 176, thus effectively connecting groove 126 to conduit 127*a* while isolating grooves 126' and 126'' from conduit 127*a*. With the piston 174 in this position, hydraulic drawing medium at pressure $P_0$ is supplied via holding valve 130 (see FIGS. 8–11) to the underside of control face 147 of control slide 112, thereby causing control valve 110 to shift positions. As a result the piston 103 has a relatively short stroke. If the pressure in conduit 182 is raised by a predetermined increment, thus connecting conduits 162 and 170, groove 126' is the effective one and the stroke has an intermediate length. When the pressure in conduit 182 is higher still, conduits 164 and 172 are connected and the stroke of piston 103** is at a maximum.

The value of n is three in this example. However it will be understood that the value could be increased by adding further annular grooves (corresponding to grooves 126, 126' and 126'') and conduit pairs communicating With bore 166.

Returning to FIG. 4, the output of adjustment member 33 communicates via a z/Q limit value generator 35 with the input of controller 31 (controller 31 may be a comparator). Limit value generator 35 responds to the signal from adjustment member 33 so as to adapt the limit value $(z/Q)_0$ to the momentarily set stroke (that is, the current stroke magnitude) of striking piston 8.

If the measured value z/Q furnished by calculating member 29 reaches the magnitude of the limit value predetermined by means of z/Q limit value generator 35, controller 31 acts by way of a control instruction on adjustment member 33 . Adjustment member 33 responds by changing the internal resistance of hydraulic hammer 6.

With reference to FIG. 12, adjustment member 33 includes a switch 50 having a fixed contact 52 that is connected to a voltage source and a fixed contact 54 that is grounded. Switch 50 can be manually manipulated to select either the low stroke amplitude (i.e., piston 174 positioned as shown in FIG. 12) or the intermediate stroke amplitude (where conduits 162 and 170 are connected via the gap between piston portions 176 and 178). The movable contact is electrically connected to fixed contact 54 to attain the low stroke amplitude and to fixed contact 52 to attain the high stroke amplitude. A summing amplifier 56 has inputs connected to controller 31 and switch 50. Summing amplifier adds either zero (if fixed contact 54 is selected) or $V^+$ (if fixed contact 52 is selected) to the output of controller 31. This sum is supplied both to limit valve generator 35 and to a motor control circuit 58. Motor control circuit 58 drives a motor 60 at a speed governed by the input voltage to circuit 58—the higher the input voltage from amplifier 56, the higher the motor speed. Motor 60 in turn drives a small hydraulic pump whose output pressure is determined by the speed of motor 60. This pressure is conveyed to conduit 182.

Although not shown, limit value generator 35 can be made using a resistor and a potentiometer series-connected between a voltage source and ground to provide an adjustable voltage divider, with the output of summing amplifier 56 being subtracted by a differential amplifier from the output of the voltage divider.

The control is based on the realization that the ratio between the values measured for the striking rate z and the incoming stream rate $Q_e$ also increases with increasing reflection factor R values. If these values reach the predetermined z/Q limit value, which is variable as a function of the striking piston stroke, adjustment member 33 lengthens the stroke of the striking piston under the influence of controller 31. This produces a corresponding change in the internal resistance of hydraulic hammer 6 which, under otherwise unchanged operating conditions, results in an increase in the energy of each individual stroke and a drop in the striking rate. Correspondingly, the z/Q value decreases as well.

The embodiment according to FIG. 4 can be configured to advantage by providing that the striking rate limit value $z_0$ is predetermined as a function of the magnitude of the currently-set striking piston stroke. Such an embodiment is shown in FIG. 5, in which hydraulic hammer 6 is shown, for reasons of clarity, without the virtual pump 12 that indicates energy recovery (see in this connection also FIG. 4).

Figure 5:
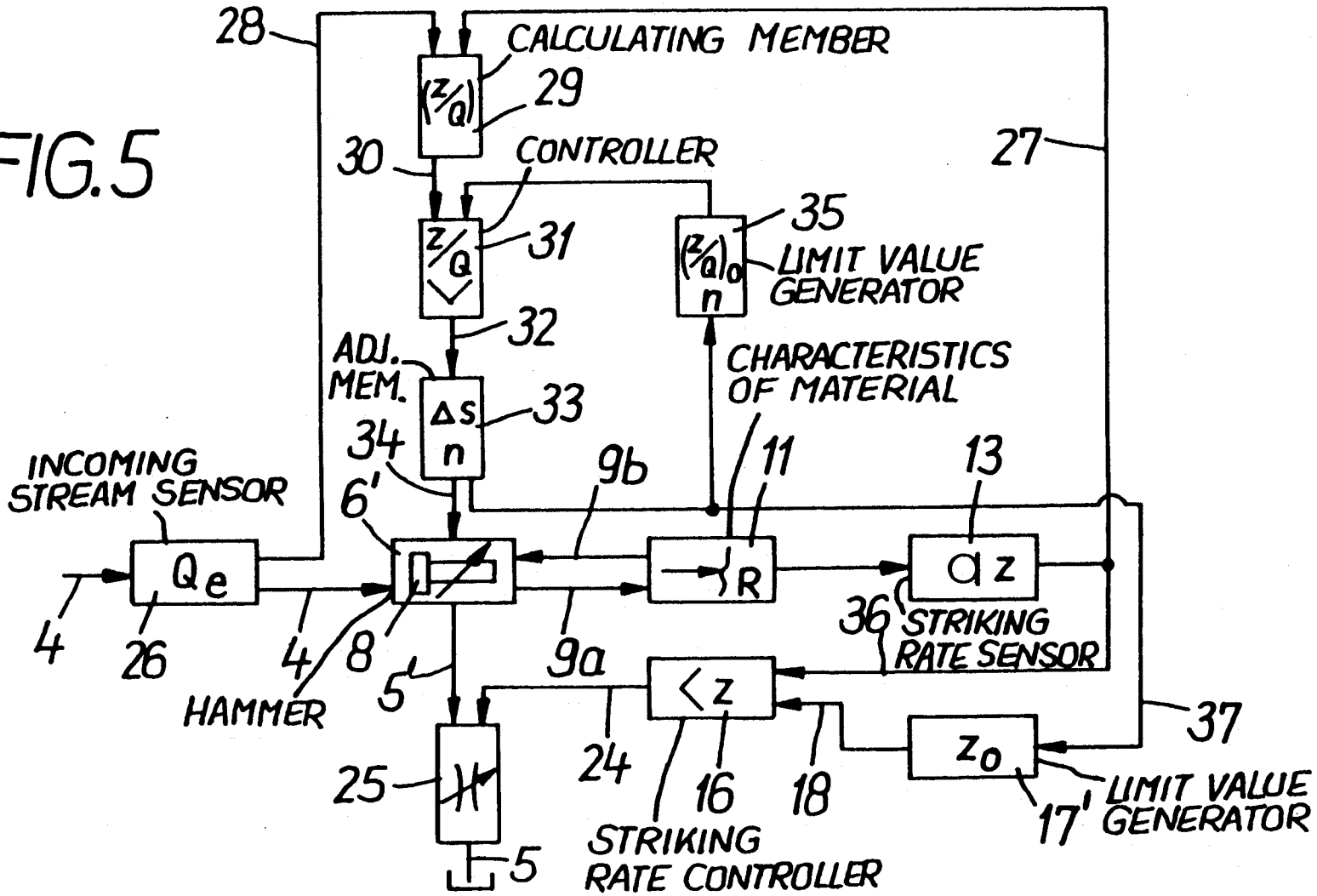
FIG. 5 is a block circuit diagram for an apparatus similar to the embodiment shown in FIG. 4, in which additionally the return movement resistance of an adjustable stroke percussion mechanism is varied as a function of the magnitude of the measured striking rate.

In order to prevent a possibly undesirable increase in the striking rate z, the apparatus of FIG. 5 is additionally equipped with a striking rate limit value generator 17', a striking rate controller 16, and an adjustment member in the form of an adjustment choke 25 connected to its output. As has already been discussed in connection with FIG. 3, the adjustment choke 25 is installed in the return conduit 5' of hydraulic hammer 6. By way of a measuring line 36, the input of striking rate controller 16 is connected with striking rate sensor 13 and, by way of input 18, with striking rate limit value generator 17'. The latter receives a signal from adjustment member 33 through a signal line 37 so as to switch the striking rate limit value $z_0$ according to the magnitude of the striking piston stroke. Although not shown, limit value generator 17' can include an adjustable voltage divider and a differential amplifier which subtracts the output of summing amplifier 56 from the output of the voltage divider.

If the measured striking rate value z rises to the striking rate limit value, as adapted to the magnitude of the stroke of the striking piston, striking rate controller 16 initiates, through control line 24, a reduction of the flow cross section of return conduit 5' by actuating adjustment choke 25. This change results in an increase in the internal resistance of hydraulic hammer 6 (connected with a rise in the return movement pressure in return conduit 5') and a drop in the striking rate z.

The described embodiment thus ensures that, under the influence of the striking rate controller 16, the striking rate in every region is limited to the magnitude of the striking rate limit value $z_0(n)$.

Figure 6:
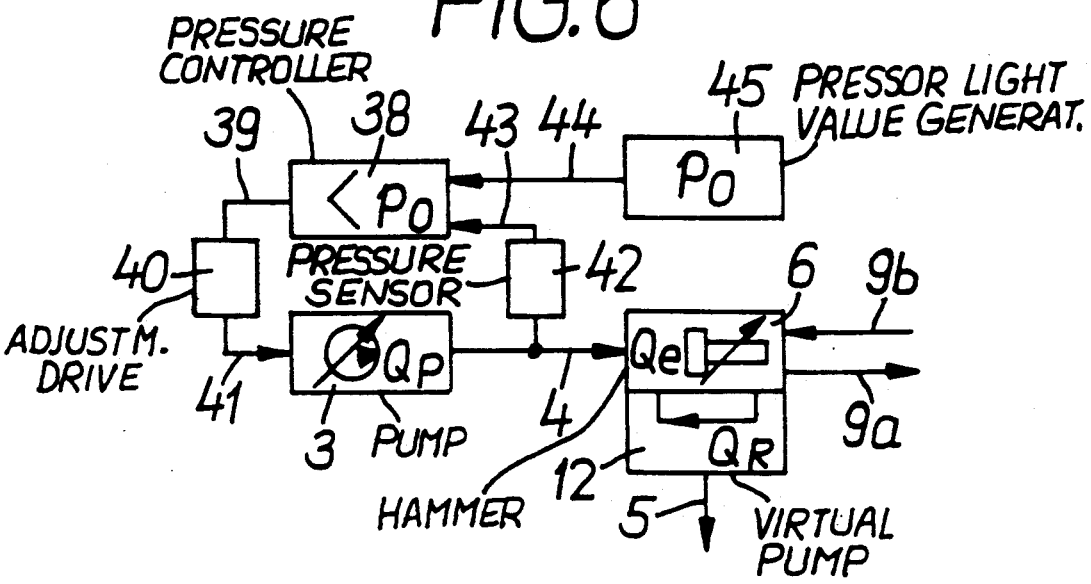
FIG. 6 is a block circuit diagram for a pressure control system by means of which the operating pressure existing in the stream being conveyed can be influenced.

In deviation from the use of pump 3' and pressure limiting valve 22 in FIGS. 3 and 4 (which arrangement can also be employed for the subject matter of FIG. 5) the hydraulic pump ma be configured as a variable displacement pump having a variable output rate, with operating state of the pump being monitored and adapted, if required, by means of a pressure controller (FIG. 6).

For this purpose, hydraulic pump 3 is equipped with a pressure controller 38 (such as a comparator) that acts by way of a control line 39 on an adjustment drive 40, by means of which the magnitude of the conveyance rate of hydraulic pump 3 can be varied as indicated by an arrow 41. Adjustment drive 40 may include a motor and means for switching it on in response to a signal from controller 38.

At its input, pressure controller 38 is connected, through the intermediary of a pressure sensor 42 and a measuring line 43, to pressure conduit 4. Pressure controller 38 is additionally in communication by way of an input 44 with a pressure limit value generator 45 (for example, an adjustable voltage divider). The latter provides the adjustable magnitude of the pressure limit value p to be processed by pressure controller 38. If the operating pressure p picked up by pressure sensor 42 rises to the predetermined pressure limit value $p_0$, pressure controller 38 initiates actuation of adjustment drive 40 by way of control line 39. Adjustment drive 40 then causes the conveyance rate of hydraulic pump 3 to be reduced, thereby increasing the pump's internal resistance. That is, the exiting stream from pump 3 is reduced and thus the operating pressure in pressure conduit 4 is reduced as well.

The advantage realized with this additional pressure regulation is that hydraulic hammer 6 can be charged in each case with the highest permissible operating pressure.

Figure 7:
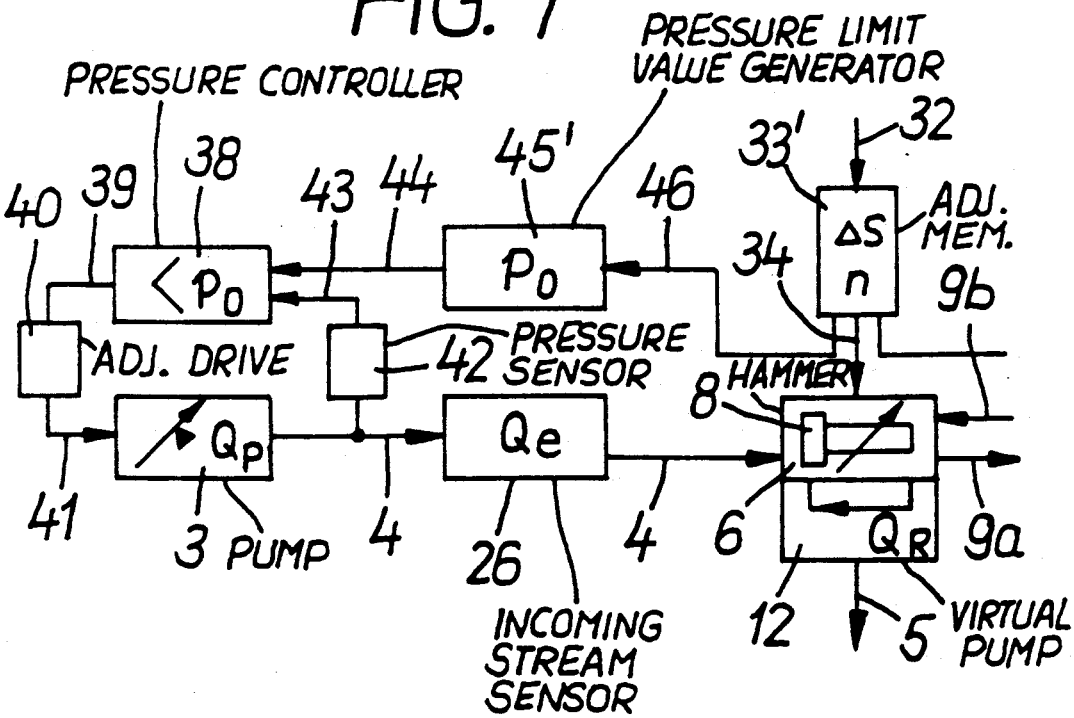
FIG. 7 is a block circuit diagram for the pressure control of the embodiments of FIGS. 4 or 5, in which the pressure limit value is predetermined as a function of the magnitude set for the percussion mechanism stroke.
Figures 8, 9:
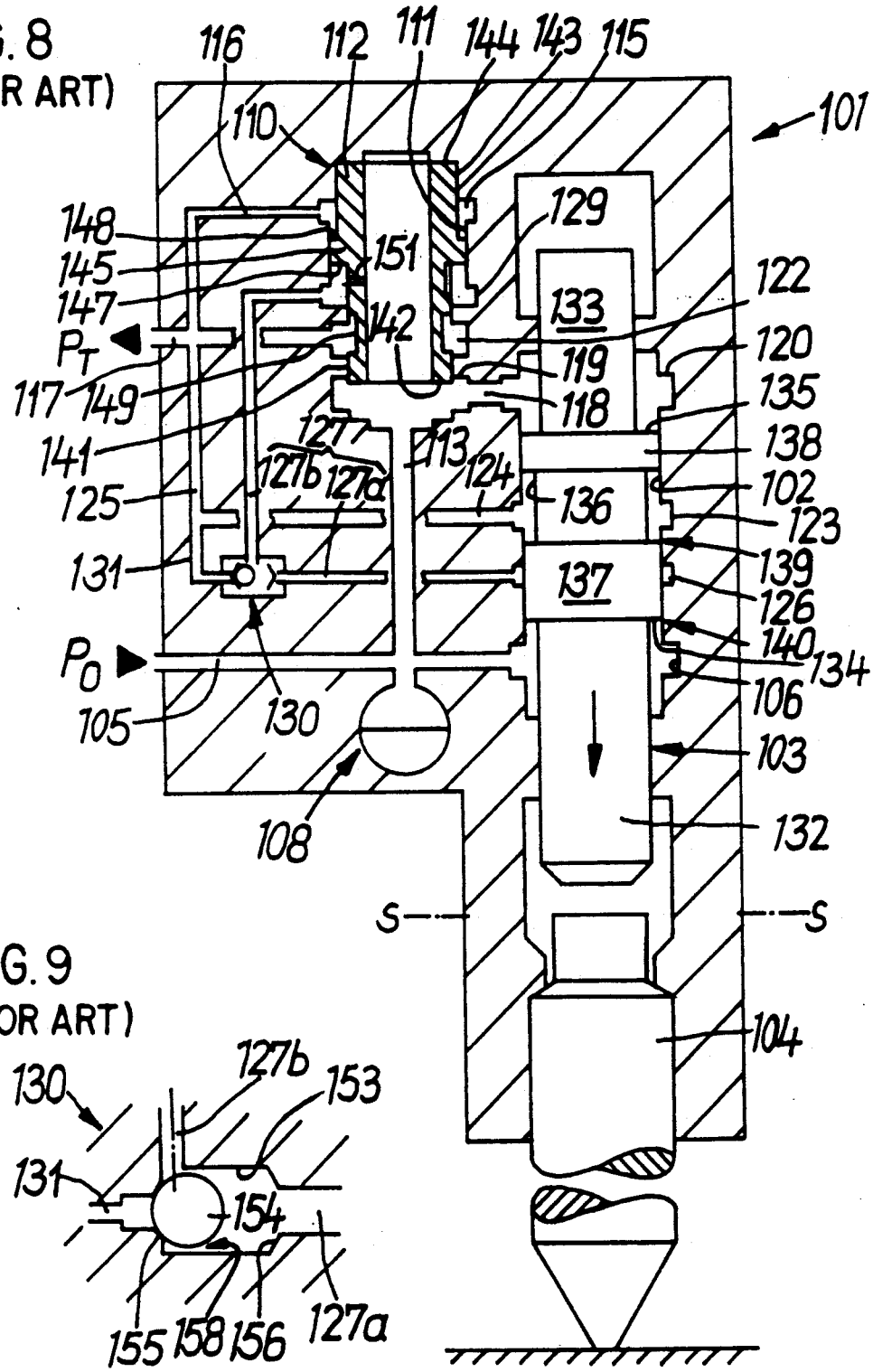
FIG. 8 (PRIOR ART)
FIG. 9 (PRIOR ART)
FIG. 8 is a schematic, longitudinal section view of a hydraulic percussion mechanism which can be used in conjunction with the present invention, the percussion mechanism being shown during the operating stroke.
FIG. 9 is an enlarged view of the holding valve during the operating stroke.
Figure 10:
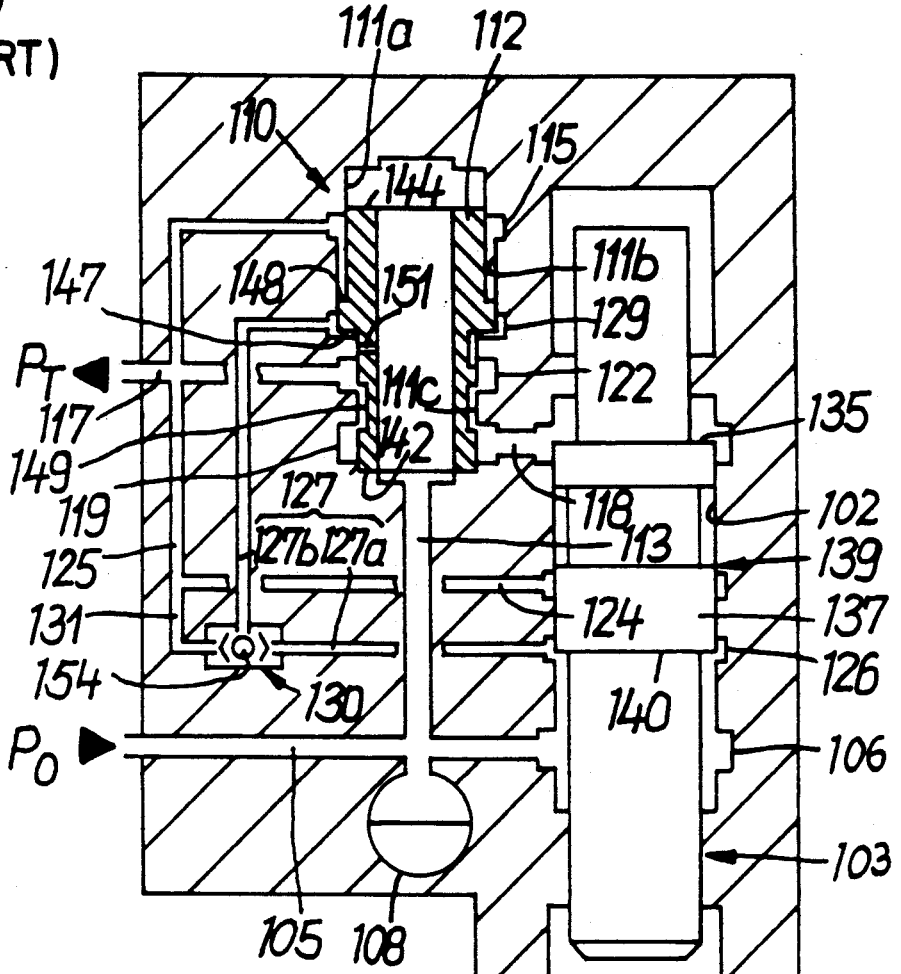
FIG. 10 (PRIOR ART)
FIG. 10 is a partial longitudinal sectional view illustrating the percussion mechanism at the moment at which the control slide is disposed in the lower end position and the percussion piston has reached units upper end position at the end of the return stroke.
Figure 11:
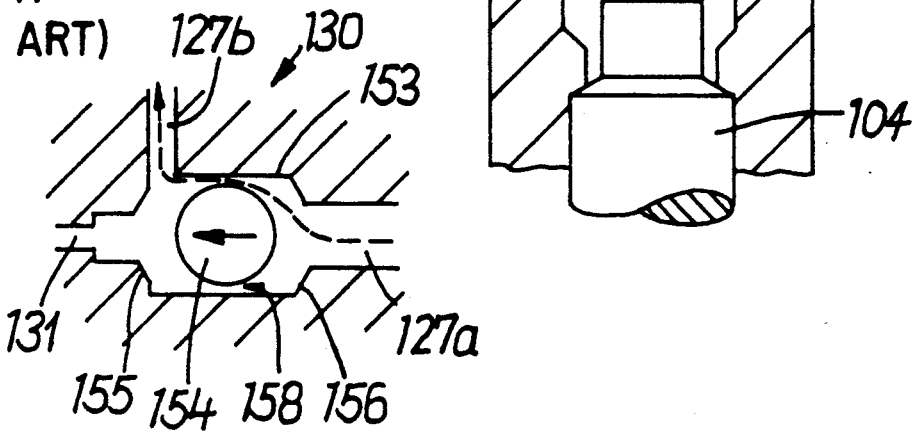
FIG. 11 (PRIOR ART)
FIG. 11 shows the holding valve during a change from the right valve seat to the left valve seat after connection of the control conduit to the pressure conduit.

FIG. 7 depicts an advantageous modification of the embodiment of FIG. 5 for the case in which hydraulic pump 3 is configured as a variable displacement pump having a variable conveyance rate and pressure control as in FIG. 6.

The pressure limit value generator 45' in FIG. 7 is here additionally connected by way of a line 46 to an adjustment member 33' for controlling the magnitude of the stroke of the striking piston. Signals from adjustment member 33' adapt the magnitude of pressure limit value $p_0$, as predetermined by pressure limit value generator 45', to the currently-set stroke of the striking piston. Adjustment member 33' may be constructed as shown for member 33 in FIG. 12, except that line 46 (to pressure limit value generator 45') is connected at the output of summing amplifier 56. Although not shown, pressure limit value generator 45' can be made using a resistor and a potentiometer that are series-connected between a voltage source and ground, with the output of summing amplifier 56 being subtracted by a differential amplifier from the output of a voltage divider.

What all of the above-mentioned embodiments have in common is that the measurement of the performance characteristic of interest for the percussion mechanism (the striking piston striking rate and the striking piston striking rate together with the incoming stream rate) are performed with the use of sensors arranged outside of the percussion mechanism.

The advantage realized with the present invention is that the adaptation of the operational behavior of hydraulically operated percussion mechanisms is based on the measurement of at least one of the two performance characteristics of the percussion mechanism—the striking piston striking rate z and quantity per unit time of the stream $Q_e$ coming into the percussion mechanism—and is thus substantially independent thereof. Any associated controllers can therefore be configured and attached in an optimum manner and can also be employed with differently configured percussion mechanisms.

It will be understood that the above description of the present invention is susceptible to various modifications, changes, and adaptations, and the same are intended to be comprehended within the meaning and range of equivalents of the appended claims.

What is claimed is:

1. A method for pounding material using a first operational unit, which receives energy at an input port from a second operational unit, while adapting the operational behavior of the first operational unit to the hardness of the material being pounded, both operational units having respective internal resistances, the second operational unit being a conveying unit which conveys a hydraulic driving medium to the input port of the first operational unit and the first operational unit being a percussion mechanism having a striking piston which is reciprocated by the driving medium, said method comprising the steps of:

(a) determining a measured value, step (a) including measuring the striking rate of the striking piston from outside the percussion mechanism; (b) generating a limit value; (c) supplying the measured value and the limit value to a control system; and (d) adjusting the internal resistance of one of the operational units with an adjustment member in such a manner that the internal resistance is increased if the measured value rises to the limit value, the adjustment member being responsive to a control instruction generated by the control system.

2. The method of claim 1, wherein the percussion mechanism has a return movement resistance, wherein the measured value determined in step (a) corresponds to the striking rate, wherein the limit value generated in step (b) is an adjustable striking rate limit value, and wherein step (d) is conducted by increasing the return resistance of the percussion mechanism on the basis of a control instruction obtained from the striking rate if the striking rate rises to the striking rate limit value.

3. The method of claim 2, wherein the driving medium furnished by the conveying unit has an operating pressure, and further comprising reducing the volume of the driving medium conveyed per unit time to the input port of the percussion mechanism if the operating pressure rises to a predetermined pressure limit value.

4. The method of claim 1, wherein the percussion mechanism additionally has an outlet port, a return conduit which communicates with the outlet port, and a choke valve in the return conduit, wherein the measured value determined in step (a) corresponds to the striking rate, wherein the limit value generated in step (b) is an adjustable striking rate limit value, and wherein step (d) is conducted by adjusting the choke valve on the basis of a control instruction derived from the striking rate if the striking rate rises to the striking rate limit value.

5. The method of claim 4, wherein the driving medium furnished by the conveying unit has an operating pressure, and further comprising reducing the volume of the driving medium conveyed per unit time to the input port of the percussion mechanism if the operating pressure rises to a predetermined pressure limit value.

6. The method of claim 1, wherein the measured value determined in step (a) corresponds to the striking rate, wherein the limit value generated in step (b) is an adjustable striking rate limit value, and wherein step (d) is conducted by adjusting the rate at which the driving fluid is conveyed by the conveying unit on the basis of a control instruction derived from the striking rate if the striking rate rises to the striking rate limit value.

7. The method of claim 1, wherein the percussion mechanism is an adjustable stroke percussion mechanism having a stroke whose magnitude can be set, wherein step (a) further includes determining the rate at which the driving medium enters the input port, the measured value of step (a) corresponding to the ratio of the striking rate to the rate at which the driving medium enters the input port, wherein the limit value generated during step (b) is predetermined as a function of the magnitude set for the stroke of the percussion mechanism, and wherein the internal resistance of the percussion mechanism is increased during step (d) by adjusting the magnitude set for the stroke if the ratio of the striking rate to the rate at which the driving medium enters the input port rises to the limit value.

8. The method of claim 7, wherein the driving medium furnished by the conveying unit has an operating pressure, and further comprising reducing the volume of the driving medium conveyed per unit time to the input port of the percussion mechanism if the operating pressure rises to a predetermined pressure limit value.

9. The method of claim 7, wherein the percussion mechanism additionally has an outlet port, a return conduit which communicates with the outlet port, and a choke in the return conduit, and further comprising the steps of generating a striking rate limit value, the striking rate limit value being a predetermined function of the magnitude set for the stroke of the percussion mechanism, and adjusting the choke value if the striking rate to the striking rate rises limit value.

10. The method of claim 9, wherein the driving medium furnished by the conveying unit has an operating pressure, and further comprising reducing the volume of the driving medium conveyed per unit time to the input port of the percussion mechanism if the operating pressure rises to a predetermined pressure limit value.

11. The method of claim 10, wherein the pressure limit value is predetermined as a function of the previously set magnitude set for the stroke of the percussion mechanism.

12. An apparatus for use in a method in which material is pounded using a first operational unit, which receives energy at an input port from a second operational unit, while the operational behavior of the first operational unit is adapted to the hardness of the material being pounded, both operational units having respective internal resistances, the second operational unit being a conveying unit which conveys a hydraulic driving medium to the input port of the first operational unit and the first operational unit being a percussion mechanism having a striking piston which is reciprocated by the driving medium, the method including the steps of (a) determining a measured value, step (a) including measuring the striking rate of the striking piston from outside the percussion mechanism, (b) generating a limit value, (c) supplying the measured value and the limit value to a control system, and (d) adjusting the internal resistance of one of the operational units with an adjustment member in such a manner that the internal resistance is increased if the measured value rises to the limit value, the adjustment member being responsive to a control instruction generated by the control system, wherein said apparatus comprises:

striking rate sensor means, disposed outside the percussion mechanism, for measuring the striking rate in step (a) of the method, the striking rate sensor means having an output;

a striking rate controller connected to the output of the striking rate sensor means;

adjusting member means, responsive to the striking rate controller, for increasing the internal resistance of one of the operational units, in step (d) of the method, if the value of the striking rate measured by the striking rate sensor means rises to the limit value.

13. The apparatus of claim 12, wherein the percussion mechanism additionally has an output port, a return conduit which communicates with the output port, and a choke valve in the return conduit, and wherein the adjustment member means comprises means for adjusting the choke valve.

14. The apparatus of claim 13, wherein the adjustment member means comprises adjustment drive means for varying the rate at which the drive medium is conveyed by the conveying means.

15. The apparatus of claim 12, further comprising pressure sensor means for measuring the pressure of the drive medium conveyed from the conveying unit, means for generating a predetermined pressure limit value, a pressure controller connected to the pressure sensor means and to the means for generating a predetermined pressure limit value, and adjustment drive means, connected to the pressure controller and the conveying unit, for adjusting the rate which the drive medium is conveyed by the conveying unit if the pressure of the drive medium conveyed from the conveying unit rises to the pressure limit value.

16. An apparatus for use in a method in which material is pounded using a first operational unit, which receives energy at an input port from a second operational unit, while the operational behavior of the first operational unit is adapted to the hardness of the material being pounded, both operational units having respective internal resistances, the second operational unit being a conveying unit which conveys a hydraulic driving medium to the input port of the first operational unit and the first operational unit being an adjustable percussion mechanism having a striking piston which is reciprocated by the driving medium, the percussion mechanism having a stroke whose magnitude can be set, the method including the steps of (a) determining a measured value, step (a) including measuring the striking rate of the striking piston from outside the percussion mechanism and determining the rate at which the operating fluid enters the input port, the measured value corresponding to the ratio of the striking rate to the rate at which the operating fluid enters input port, (b) generating a limit value, the limit value being predetermined as a function of the magnitude set for the stroke of the percussion mechanism, (c) supplying the measured value and the limit value to a control system, and (d) adjusting the internal resistance of one of the operational units with an adjustment member in such a manner that the internal resistance is increased by adjusting the magnitude set for the stroke if the measured value rises to the limit value, the adjustment member being responsive to a control instruction generated by the control system, said apparatus comprising:

striking rate sensor means, disposed outside the percussion mechanism, for measuring the striking rate in step (a) of the method;

incoming drive fluid sensor means, disposed outside the percussion mechanism, for determining the rate at which the operating medium enters the input port in step (a) of the method;

calculating member means, responsive to the striking rate sensor means and to the incoming drive fluid sensor means, for determining the measured value in step (a) of the method by finding the ratio of the striking rate to the rate at which the driving fluid enters the input port;

a controller connected to the calculator member means, the controller receiving the measured value and the limit value in step (c) of the method; and adjustment member means, responsive to the controller, for increasing the internal resistance of the percussion mechanism in step (d) of the method if the measured value rises to the limit value.

17. The apparatus of claim 16, wherein the adjustment member means comprises means for varying the magnitude of the stroke of the percussion mechanism in stages.

18. The apparatus of claim 16, wherein the percussion mechanism additionally has an output port, a return conduit which communicates with the output port, and a choke valve in the return conduit, and wherein the apparatus further comprises striking rate limit value generator means for generating a striking rate limit value that is predetermined as a function of the previously set magnitude of the stroke of the percussion mechanism, and means responsive to the striking rate limit generator means and to the striking rate sensor means for actuating the choke valve if the striking rate rises to the striking rate limit value.

19. The apparatus of claim 16, further comprising pressure sensor means for measuring the pressure of the drive medium conveyed from the conveying unit, means for generating a predetermined pressure limit value, a pressure controller connected to the pressure sensor means and to the means for generating a predetermined pressure limit value, and adjustment drive means, connected to the pressure controller and the conveying unit, for adjusting the rate at which the drive medium is conveyed by the conveying unit if the pressure of the drive medium conveyed from the conveying unit rises to the pressure limit value.

20. The apparatus of claim 19, wherein the means for generating a predetermined pressure limit value comprises means, responsive to the magnitude of the stroke of the percussion mechanism, for generating the pressure limit value as a function of the magnitude set for the stroke.

* * * * *